US010461459B1

(12) United States Patent
Carey et al.

(10) Patent No.: US 10,461,459 B1
(45) Date of Patent: Oct. 29, 2019

(54) SWITCHED ELECTRICAL PLUG LOCK

(71) Applicant: The Chamberlain Group, Inc., Oak Brook, IL (US)

(72) Inventors: Michael Carey, Knoxville, TN (US); Casparus Cate, Chicago, IL (US); Timothy Karl Nowack, Des Plaines, IL (US)

(73) Assignee: The Chamberlain Group, Inc., Oak Brook, IL (US)

( * ) Notice: Subject to any disclaimer, the term of this patent is extended or adjusted under 35 U.S.C. 154(b) by 0 days.

(21) Appl. No.: 15/688,544

(22) Filed: Aug. 28, 2017

(51) Int. Cl.
*H01R 13/60* (2006.01)
*H01R 13/453* (2006.01)
*H01R 13/629* (2006.01)
*H01R 24/22* (2011.01)

(52) U.S. Cl.
CPC ..... *H01R 13/4532* (2013.01); *H01R 13/629* (2013.01); *H01R 24/22* (2013.01)

(58) Field of Classification Search
CPC ..... H01R 13/53; H01R 13/60; H01R 13/629; H01R 13/6397; H01R 13/4532; H01R 2103/00; H01R 24/22
USPC .. 439/186–188, 346, 13–149, 373, 534, 535
See application file for complete search history.

(56) References Cited

U.S. PATENT DOCUMENTS 4,063,110 A * 12/1977 Glick ..... H01R 13/6397 174/67
4,136,919 A * 1/1979 Howard ..... H01R 13/20 439/346
4,479,688 A * 10/1984 Jennings ..... H01R 13/6397 200/43.02
5,061,199 A * 10/1991 McClead ..... H01R 13/6397 200/43.02
5,434,368 A * 7/1995 Hoffmann ..... H01R 13/6397 200/43.22
5,605,466 A * 2/1997 Devlin ..... H01R 13/447 439/144
5,773,760 A * 6/1998 Stark ..... H02G 3/088 174/66
6,416,362 B1 * 7/2002 Conrad ..... H01R 13/6397 200/51 R
7,057,547 B2 * 6/2006 Olmsted ..... E05F 15/77 340/12.3

(Continued)

OTHER PUBLICATIONS

YouTube video entitled "Lock in Plug—how it works—the only locking plug adapter!," posted Jul. 13, 2017, screen captures and video description, 6 pages. <https://www.youtube.com/watch?v=i1__fbweYU8>.

(Continued)

*Primary Examiner* — Edwin A. Leon
*Assistant Examiner* — Milagros Jeancharles
(74) *Attorney, Agent, or Firm* — Fitch, Even, Tabin & Flannery LLP

(57) ABSTRACT

An apparatus for controlling use of an electrical device. The apparatus includes at least one power connector, a first electrical plug, an electrical socket, a lock configured to retain an electrical plug in the electrical socket, a switch electrically coupling the at least one power connector and the electrical socket, and wireless communication circuitry communicatively coupled to the switch and configured to receive a signal for causing the switch to electrically couple the at least one power connector and the electrical socket.

28 Claims, 8 Drawing Sheets

(56) References Cited

U.S. PATENT DOCUMENTS

| | | | | |
|---|---|---|---|---|
| 7,080,889 | B2 * | 7/2006 | Ling | H01R 13/6397 200/334 |
| 7,284,995 | B1 * | 10/2007 | Vail | H01R 13/447 439/133 |
| 7,431,594 | B2 * | 10/2008 | Castaldo | H01R 13/6395 174/67 |
| 8,172,599 | B2 * | 5/2012 | Konchan | H01R 13/6397 439/352 |
| 8,900,006 | B2 * | 12/2014 | Gaul | H01R 13/465 439/489 |
| 8,951,060 | B2 * | 2/2015 | Meyer-Ebeling | H01R 13/639 439/347 |
| 9,450,365 | B1 * | 9/2016 | Baldwin | H01R 35/04 |
| 9,742,128 | B2 * | 8/2017 | Justice | H01R 13/713 |
| 2004/0043649 | A1 * | 3/2004 | O'Connell | H01R 13/6397 439/135 |
| 2007/0128915 | A1 * | 6/2007 | Castaldo | H01R 13/6395 439/328 |
| 2013/0222111 | A1 * | 8/2013 | Inoue | G05B 1/01 340/5.65 |
| 2014/0132084 | A1 * | 5/2014 | Pham | H01R 24/78 307/140 |
| 2014/0162478 | A1 * | 6/2014 | Wardenburg | H01R 27/00 439/136 |
| 2017/0237198 | A1 * | 8/2017 | Sathyanarayana | H01R 13/5202 439/105 |

OTHER PUBLICATIONS

LOCKinPLUG website, accessed Sep. 14, 2017, 2 pages. <http://www.lockinplug.com/>.

Uline—Electrical Plug Cover Lockout—Large H-3436; Catalog Sheet; Accessed Jul. 13, 2017; https://www.uline.com/Product/Detail/H-3436/Lockout-Tagout/Electrical-Pluf-Cover-Loc.

Chamberlain Smart Lamp Control; Models PILCEV, PILCEV-P1, PILCEV & PILCEV-PA; Instruction Manual; Accessed Jul. 13, 2017.

Wemo® Insight Smart Plug; http://www.belkin.com/us/F7C029-Belkin/p/P-F7C029;isessionid=1386CED2E22F5EBC5 . . . ; Accessed Jul. 13, 2017.

* cited by examiner

SWITCHED ELECTRICAL PLUG LOCK

FIELD

This disclosure relates to electrically powered devices and, more specifically, to an apparatus for controlling power to a corded electrical device.

BACKGROUND

Plug locks connect to electrical cords of electrically powered devices and are used to prevent the electrically powered devices from being energized or powered. A plug lock covers the prongs or blades of a plug and prevents the prongs from being inserted into an electrical socket. Power tools, such as saws, are examples of electrically powered corded devices that may be disabled using plug locks. For example, locking the plug end of a saw's power/electrical cord prevents energization of and, therefore, use of the saw. One known plug lock comprises a solid housing configured to enclose a plug, and a key-operated mechanical lock securing the plug lock in position on the plug. A padlock or fastener may be used to lock the plug lock on the plug.

A wall socket lock-out may also be used to disable or otherwise control use of an electrically-powered corded device. The lock-out has a hard case configured to cover an electrical socket and an integrated mechanical lock, or structure for receiving an external lock, to secure the lock-out in position. The hard case prevents use of the electrical socket by covering the openings of the wall socket.

A number of problems exist with known plug locks and lock-outs. The electrically powered corded device is typically unplugged after every use in order to either attach the plug lock to the plug or to attach the socket lock-out to the wall socket, and then the plug lock or lock-out is removed before the electrically powered corded device can be used again. These added steps can be difficult when the sockets and/or cords are difficult to reach, such as being behind a workbench or other structure. Additionally, in order to use the electrically powered device, the plug lock on the cord of the device is completely removed from the cord. When the plug lock is removed there is a risk of the plug lock being lost. Finally, some plug locks and lock-outs employ keys or combinations to be locked and unlocked. This requires the user to carry a key or remember a combination for each device they wish lock and unlock.

DETAILED DESCRIPTION

Figure 1:
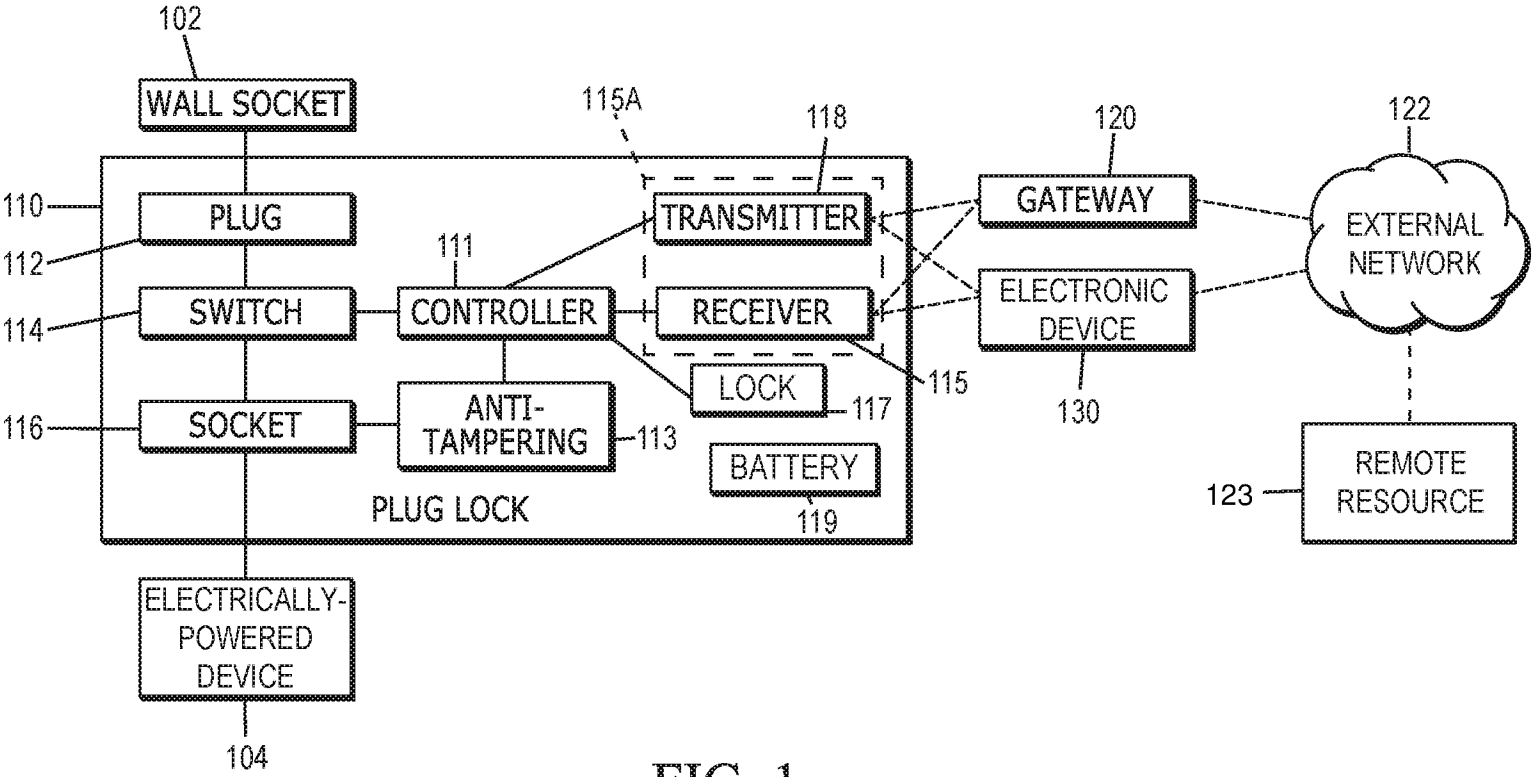
FIG. 1 is a block diagram of an example plug lock connected between a wall socket and an electrically powered device.
Figure 2:
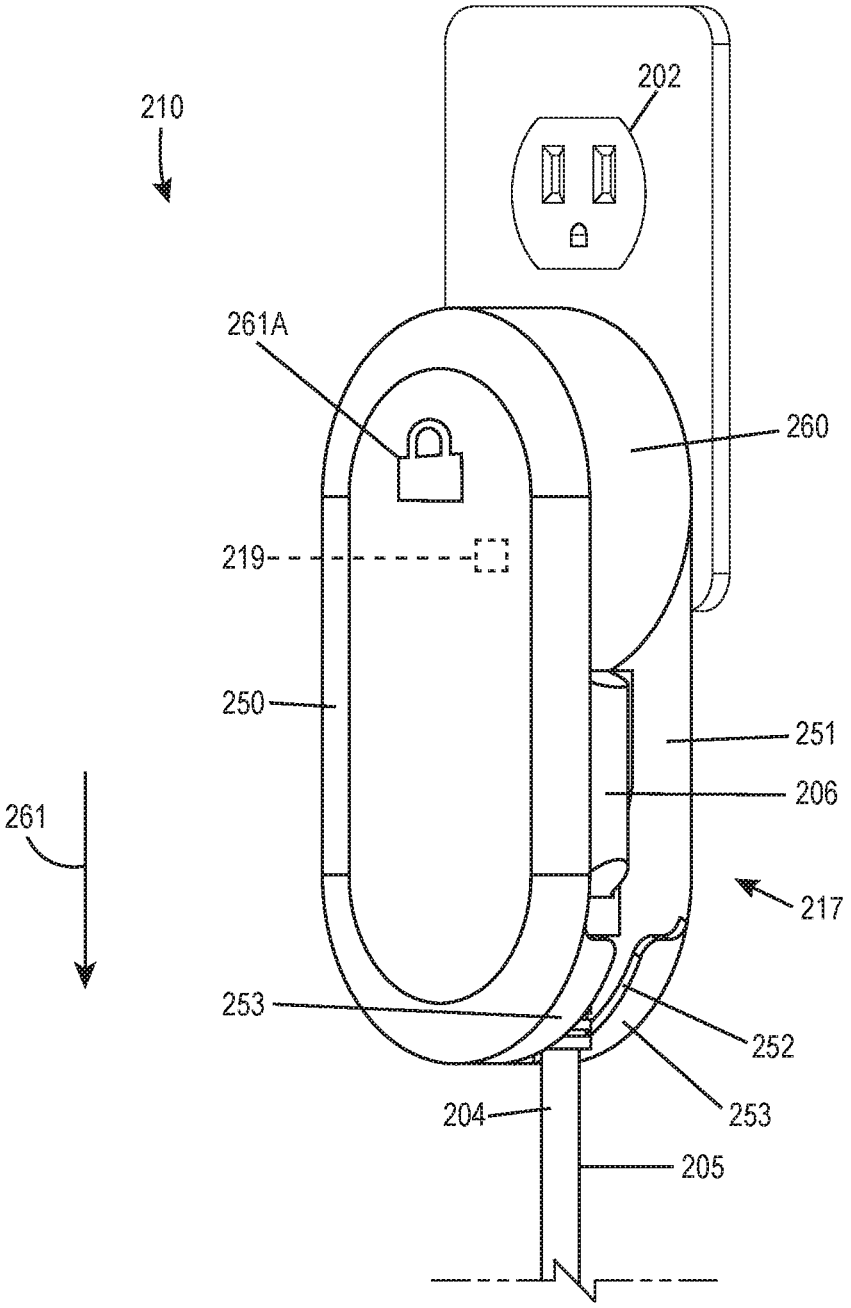
FIG. 2 is a perspective view of a plug lock in accordance with FIG. 1, connecting a plug of an electrical cord to a wall socket, with the plug lock shown in a locked configuration.
Figure 3:
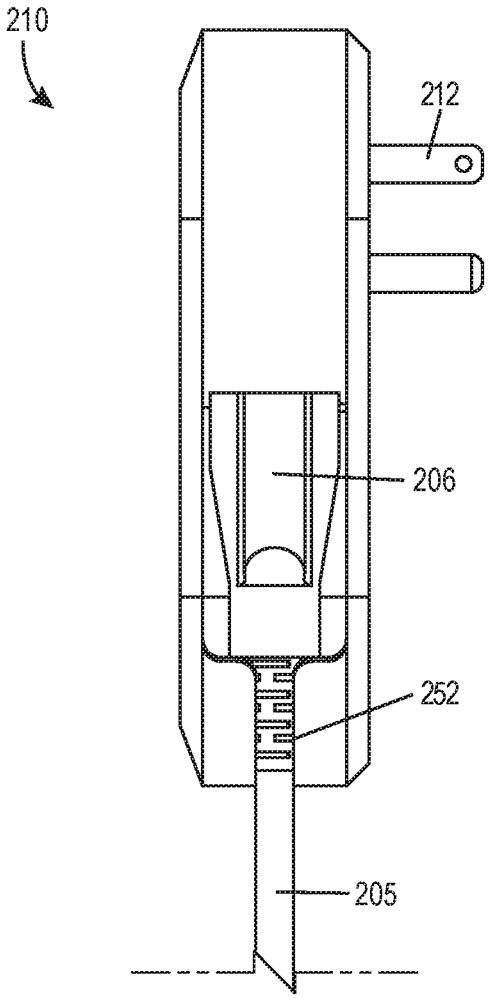
FIG. 3 is a side elevational view of the plug lock of FIG. 2 removed from the wall socket.
Figure 4A:
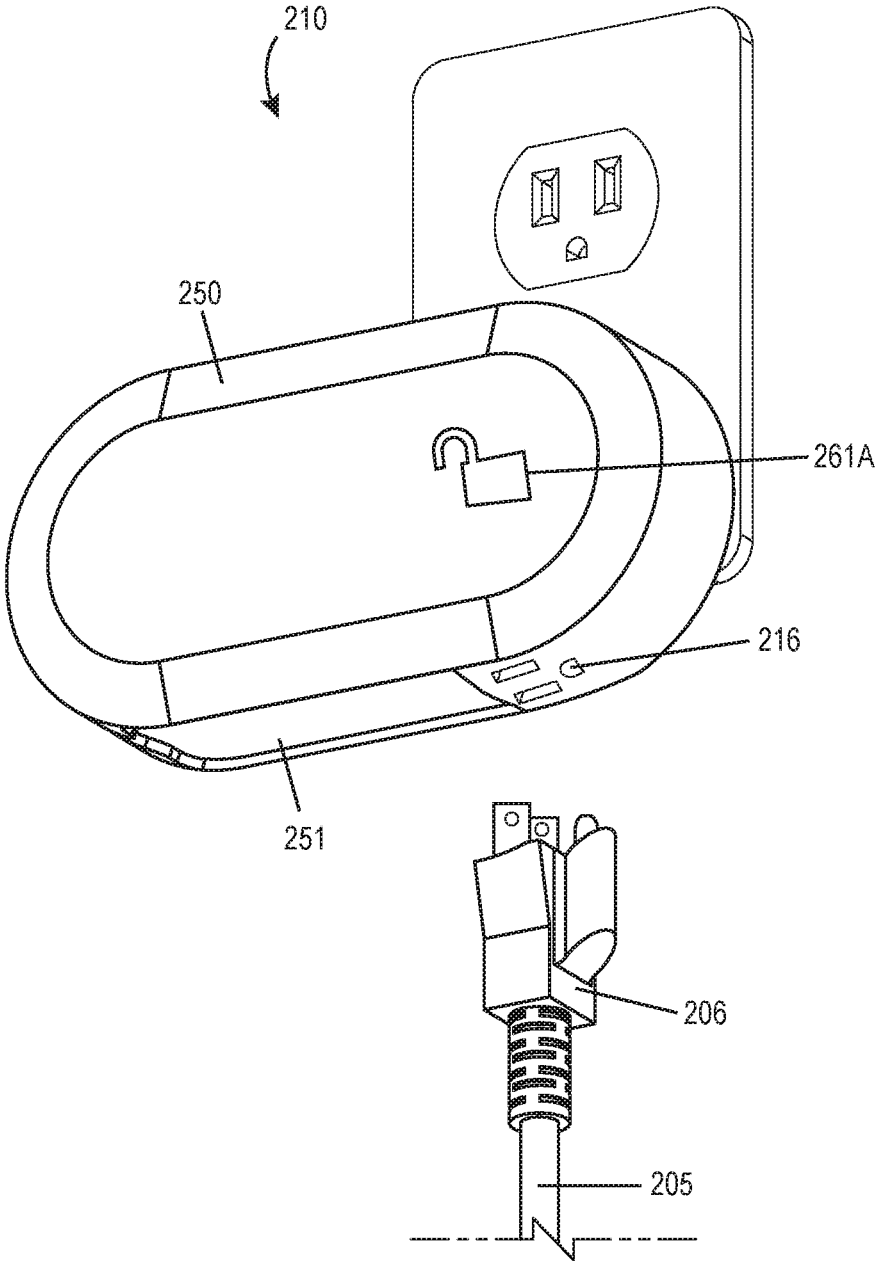
FIG. 4A is a perspective view of the plug lock of FIG. 2 showing the plug lock in an unlocked configuration and the plug of the electrical cord disconnected from the plug lock.
Figure 4B:
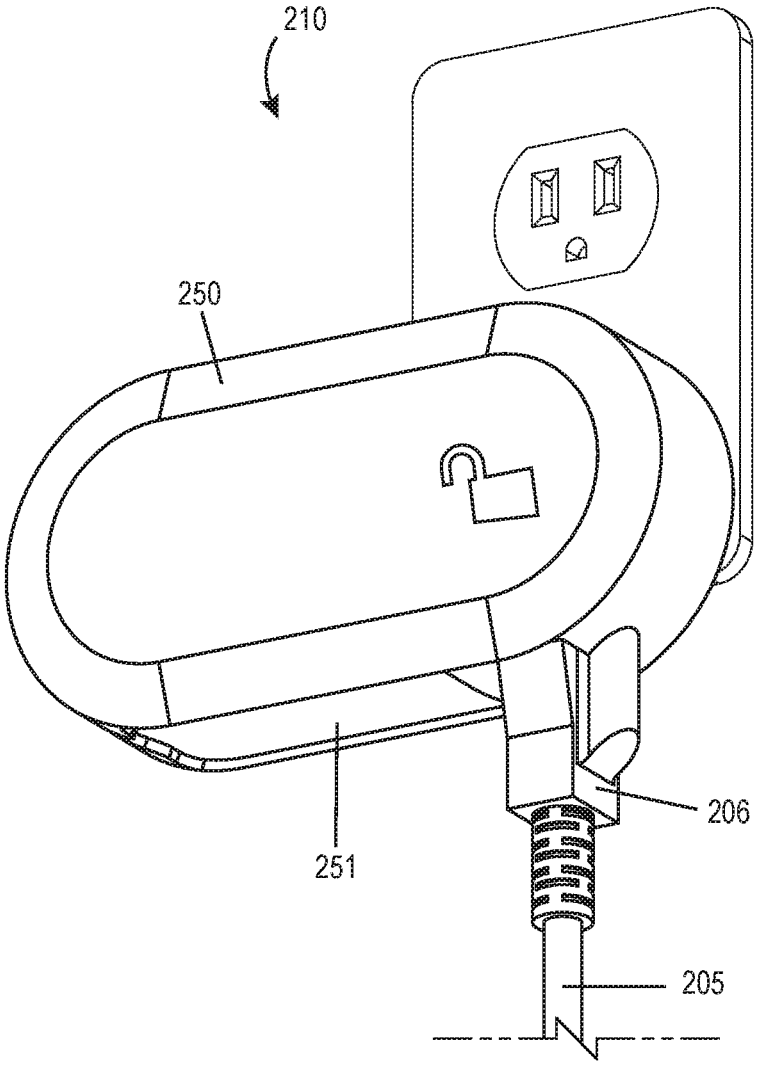
FIG. 4B is a perspective view similar to FIG. 4A showing the plug lock in the unlocked configuration and the plug of the electrical cord connected to the plug lock.
Figure 5:
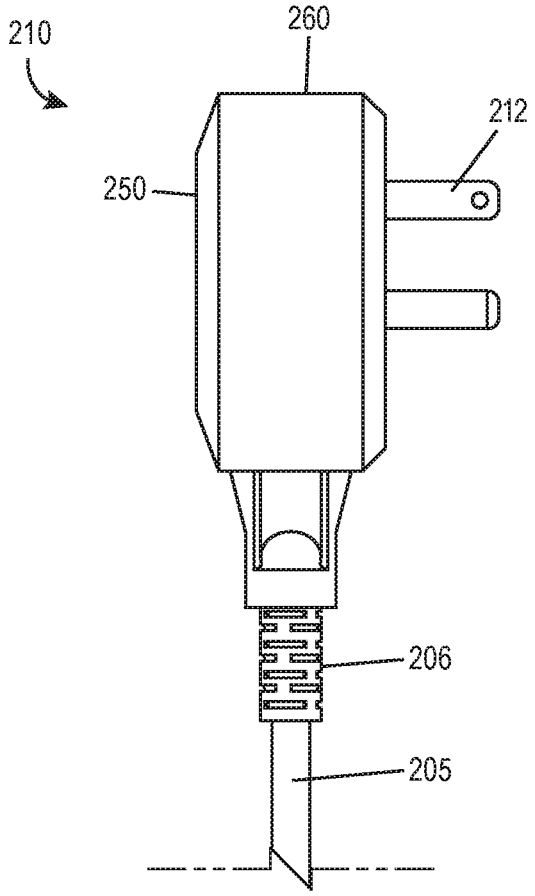
FIG. 5 is a side elevation view similar to FIG. 3 showing the plug lock in the unlocked configuration.

In accordance with one aspect of the present disclosure, an apparatus is provided for controlling the use of an electrically powered device. The apparatus includes at least one power connector configured to be coupled to an electrical power source. The at least one power connector may be configured as terminals or lead wires for coupling the apparatus to a power supply. Another example of the at least one power connector is a first electrical plug configured to plug into an electric socket. The apparatus further includes an electrical socket configured to receive a second electrical plug of an electrically powered (corded) device, and a lock configured to maintain the second electrical plug in the electrical socket. The apparatus further includes a switch operable to electrically couple the first electrical plug and the electrical socket, and wireless communication circuitry operatively coupled to the switch. The wireless communication circuitry is configured to receive a signal for causing the switch to electrically couple the first electrical plug and the electrical socket. In this manner, the operation of the electrically-powered device may be controlled by sending a wireless signal to the apparatus to operate the switch thereof.

The apparatus is connected to a power source, such as by the first electrical plug being connected to an electrical socket. The first electrical plug may include one or more prongs or blades configured to engage openings of an electrical socket of an alternating current wall receptacle. When the switch is closed, an electrical path is closed or completed through the apparatus and electric current may flow from the wall outlet, to the first electrical plug of the apparatus, and to the electrical socket of the apparatus. The energized electrical socket of the apparatus may provide electrical current to the second electrical plug (i.e., the plug end of a corded electrically powered device) that is connected to the electrical socket. When the switch is opened, the electrical path is opened such that the connection is broken between the first electrical plug of the apparatus and the electrical socket of the apparatus, wherein the electrically powered device does not receive electrical current from the wall outlet.

The apparatus may be configured so that the switch is actuated in response to the wireless communication circuitry receiving a wireless signal. In one form, the wireless communication circuitry includes a wireless receiver coupled to the switch by way of a controller. The controller receives data from the wireless communication circuitry indicating the reception of a wireless signal and the controller operates the switch in response to this data. The wireless communication circuitry is configured to receive signals over one or more wireless communication protocols. Example protocols include short-range communications such as Bluetooth®, Bluetooth low energy (BLE), infrared, Near Field Communication (NFC) WiFi, Zigbee, as well as long-range or wide-area network communications such as LoRa, 3G, 4G, LTE and 5G. The wireless communication circuitry is configured to receive signals from a gateway, such as a WiFi wireless router or access point, and/or directly from an electronic device, such as a smartphone, the received signals causing the switch to be opened or closed. For example, an application running on a smartphone can be used so that a user can select to either open or close the switch. The smartphone transmits a wireless signal associated with the user's selection to the wireless communication circuitry which, in turn, communicates data to the controller. The controller takes the action indicated by the wireless signal.

In one form, the controller is configured to close the switch when the wireless receiver detects the presence or proximity of a specific electronic device. For example, a paired relationship may be established between a smartphone and the apparatus such that the smartphone and the apparatus are configured to automatically communicate with each other via a wireless protocol such as BLE or WiFi. After the pairing is completed, the controller of the apparatus closes the switch when the smartphone and the apparatus are in proximity. When the smartphone and the apparatus are no longer in proximity, the controller opens the switch.

In one form, the apparatus additionally includes one or more sensors. The one or more sensors are configured to measure the flow of electricity through the apparatus. In one form, the one or more sensors are binary and transmit signals to the controller regarding whether or not electricity is flowing to the electrically powered device. In another form, the one or more sensors measure one or more properties of the electricity flowing to the electrically powered device and transmit the measured properties to the controller. The apparatus may also include an anti-tampering sensor. The anti-tampering sensor detects movement of the second electrical plug of the electrically-powered device relative to the apparatus. When movement is detected, the wireless communication circuitry transmits a wireless signal indicating that the plug lock is being tampered with, which may be received by a smartphone.

The lock of the apparatus retains the second electrical plug in the electrical socket of the apparatus and prevents removal therefrom. In one form, the lock includes an integrated key-operated or combination lock. In another form, the lock includes a structure configured to receive an external lock, such as a padlock. The lock may retain the second electrical plug in the electrical socket of the apparatus using a number of approaches. For example, the lock may include a pin that is advanced through openings of prongs of the second electrical plug to fix the prongs in the electrical socket of the apparatus. As another example, the apparatus may include a housing having a body and locking portions that engage an enlarged portion of the second electrical plug to hold the second electrical plug relative to the body and keep the second electrical plug connected to the electrical socket.

The lock may be electrically actuated. For example, the apparatus may include a controller and the lock may be operated by the controller. When the wireless communication circuitry receives a signal representing a command to unlock, the controller actuates the lock to release the second electrical plug such as by withdrawing the pin from the openings of the prongs of the second electrical plug. Alternatively, the lock may be actuated to unlock when the switch is closed and the first electrical plug and the socket of the apparatus are electrically coupled. For example, if the switch is closed when the presence of a particular electronic device is detected, this detection may also cause the lock to be unlocked. Thus, the second electrical plug of the electrically powered device may be removed from the electrical socket when the authorized user's electronic device is present.

Turning now to the Figures, FIG. 1 is a block diagram of an example plug lock system 100. The plug lock system 100 includes a plug lock 110 in wireless communication with an electronic device 130, such as a tablet computer, smartwatch or other wearable device, personal computer or smartphone. In some forms the electronic device may be a transmitter or clicker configured to cooperate with or otherwise actuate a garage door opener or movable barrier operator. The plug lock 110 may be in wireless communication with a wireless gateway 120 instead of or in addition to being in communication with the electronic device 130. The electronic device 130 and the gateway 120 are in wireless communication with an external network 122 such that the electronic device 130 can communicate with the plug lock 110 from a remote location via the external network 122 and the gateway 120. The external network 122 can include a public switched telephone system and the internet as some examples. The external network 122 may connect the gateway 120 and electronic device 130 to one or more remote resources 123 such as a cloud-based server, that may provide control signals to the plug lock 110 and receive data regarding usage of the plug lock 110 via the wireless gateway 120 and/or the electronic device 130. The remote resource 123 is physically discrete or distinct from, and geographically separated or removed from, the plug lock 110, gateway 120, and electronic device 130. This geographic separation may be at least one mile, several miles, or may even span different continents.

The plug lock 110 includes at least one power connector, such as a plug 112 having one or more prongs or blades configured to fit into an electrical outlet, such as a standard wall receptacle or socket 102. In an alternative form, the at least one power connector is a set of terminals or wires so that the plug lock 110 can be directly wired to (or otherwise configured to be unitary or integral with) the power supply. In yet another alternative form, the at least one power connector is a combination of the foregoing such as an electrical cord (e.g., a wire or wires terminated in a plug with prongs or blades that are insertable into an electrical socket, receptacle or outlet). The wall socket 102 connects the plug lock 110 to a main electric power supply. The plug 112 is selectively electrically coupled to a socket 116 of the plug lock 110 by way of a switch 114. When the switch 114 is closed, an electrical connection is made between the plug 112 and the socket 116. When the switch 114 is open, the electrical connection is broken. The socket 116 is configured to receive a standard electrical plug of an electrically powered device 104. The device 104 may be, for example a corded power tool, a television, or a gaming console.

In one form, the plug lock 110 includes a controller 111 that operates the switch 114. Example controllers 111 include integrated circuits CPUs, microcontrollers, microprocessors, field programmable gate arrays (FGPA), digital signal processor (DSP), and application specific integrated circuits (ASIC). The controller 111 is communicatively coupled to wireless communication circuitry 115A which may include antennas, oscillators, amplifiers, and/or modulators/demodulators, etc. For example, the wireless communication circuitry 115A may include a receiver 115 and a transmitter 118. The receiver 115 and transmitter 118 may in turn be communicatively coupled to the electronic device 130 and/or the gateway 120. In one form, the electronic device 130 transmits instructions over the external network 122, which are relayed to the receiver 115 by the gateway 120. The gateway 120 may include, for example, a wireless router or access point, a proxy server, a home automation (e.g., ZigBee, Z-wave, etc.) gateway, and the like.

The receiver 115 and transmitter 118 are configured to wirelessly communicate with external devices (such as the gateway 120 and electronic device 130) using a communication protocol or standard. Example protocols or standards include Bluetooth®, BLE, LoRa, IR, WiFi, Zigbee, 3G, and 4G. In one form, the wireless communication circuitry 115A uses Bluetooth or BLE to communicate directly with the electronic device 130. In another form, the wireless communication circuitry 115A communicates with the electronic device 130 and the gateway 120 using WiFi. In still another form, the plug lock 110 includes a plurality of receivers 115 and/or transmitters 118 or transceivers enabling it to communicate over multiple communication protocols and/or multiple radio networks. For example, in one form the plug lock 110 is configured to communicate with external devices over Bluetooth® or BLE as well as WiFi.

In some forms, the plug lock 110 further includes an anti-tampering sensor 113 and a battery 119. The battery 119 powers the controller 111, receiver 115, transmitter 118, anti-tampering sensor 113, and switch 114. In some instances the battery 119 may be electrically coupled to the plug 112 such that the battery 119 is recharged when the plug 110 receives power from the wall socket 102. In other instances the battery 119 may be one or more of disposable, replaceable and removable.

The plug lock 110 further comprises a lock 117 to secure the plug lock 110 to the plug of the electrical device 104. In one form, the lock 117 is electrically operated by the controller 111. The electrically operated lock 117 is coupled to the battery 119 such that it can be operated locally or remotely when the plug 112 is disconnected from the wall socket 102. In another form, the lock 117 is operated locally using a user-provided combination or key instead of electronically.

With reference to FIGS. 2-5, a plug lock 210 is provided for controlling the use of an electrically powered device having an electrical cord 205. The plug lock 210 includes the components of the plug lock 110 of FIG. 1, such as a plug 212, switch, socket 216, wireless communication circuitry, controller, etc. The plug lock 210 includes a lock 217 having a movable retaining member, such as a pivotal member 250. The plug lock 210 includes a main body 260 and the pivotal member 250 is pivotally connected to the main body 260. The pivotal member 250 includes an opening 251 large enough for an electrical plug 206 of the electrical cord 205 to pass through. The pivotal member 250 also includes a slot 252 that is large enough for a portion 204 of the cord 205 to extend through, but too small for the plug 206 to pass through in a direction indicated by arrow 261. A user pivots the pivotal member 250 relative to the main body 260 around the socket 116 between: a) an unlocked position (see FIG. 4A) in which the pivotal member 250 is out of the way of the socket 116; and b) a locked position (see FIG. 2) in which pivotal member 250 extends downward from the socket 116. When the pivotal member 250 is moved to the locked position, the physical connection of the electrical plug 206 of the cord 205 and the plug lock 210 is maintained. The plug lock 210 may include an indicator, such as indicium 261A, which permits a user to visually observe whether the lock 217 is locked or unlocked. In one form, the indicium 261A is illuminated (e.g., persistently or periodically) or otherwise displayed (e.g., on a display screen) and has different shapes when the lock 217 is locked or unlocked.

The lock 217 may include a fixation member 219 configured to hold the pivotal member 250 in the locked position (FIG. 2) and lock the plug lock 210 onto the electrical cord 205. For example, the lock 217 may include an actuator (e.g., a linear or rotary motor or solenoid) housed in the main body 260 that drives or urges the fixation member 219 of the lock 217 from a clearance position to an interference position. In the clearance position, the fixation member 219 is in clearance with the pivotal member 250 to permit a user to pivot the pivotal member 250 between unlocked (see FIG. 4A) and locked (see FIG. 2) positions. In the interference position, the fixation member 219 is configured to prevent the pivotal member 250 from pivoting from the locked position to the unlocked position. The fixation member 219 thereby holds the pivotal member 250 in the locked position and keeps the plug 206 engaged with the socket 216 until the actuator drives the fixation member 219 from the interference position to the clearance position.

The pivotal member 250 has flanges 253 on opposite sides of the slot 252. When the pivotal member 250 is in the locked position, the distance between the socket 116 and the flanges 253 in the direction normal to the face of the socket 116 is short enough that the plug 206 cannot be removed from the socket 116 in direction of arrow 261. In operation, the plug 206 can only be removed from the socket 116 by shifting the fixation member 219 to the clearance position and pivoting the pivoting member 250 away from the plug 206 to the unlocked position.

In another form, the plug lock 210 has a retaining member that slides in a linear manner relative to the main body 260 rather than pivoting. The retaining member is slidable from a locked position wherein the retaining member resists removal of the plug 206 from the plug lock 210 to an unlocked position wherein the plug 206 can be removed from the plug lock 210.

Figure 6:
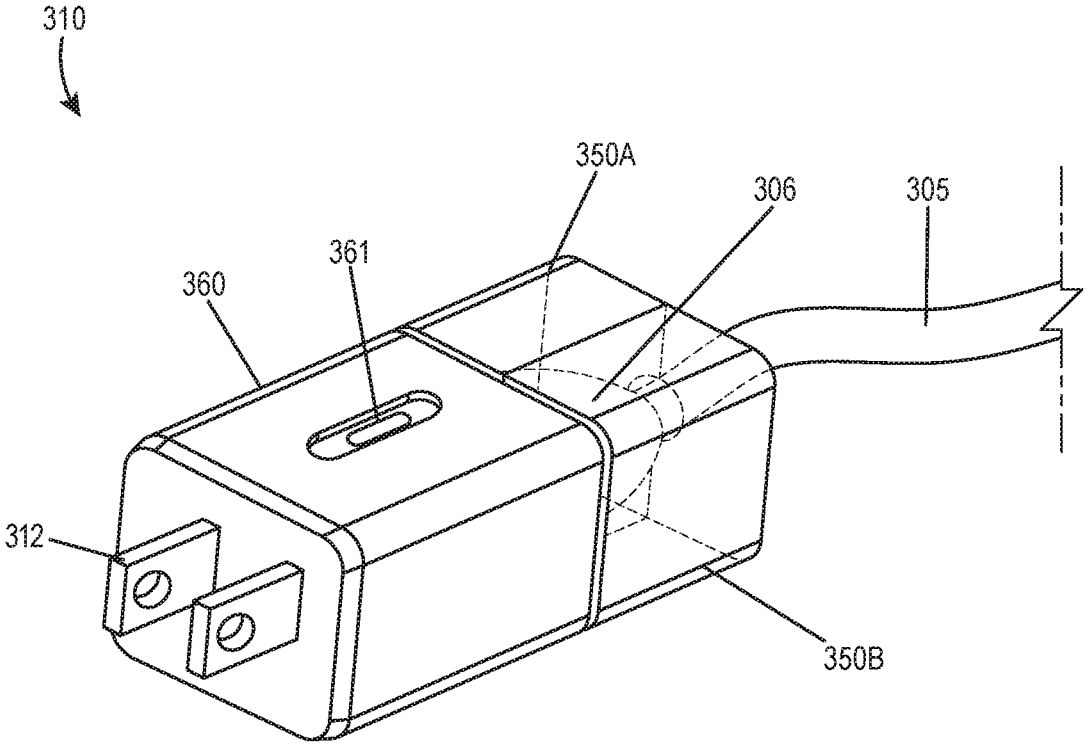
FIG. 6 is a perspective view of another plug lock in accordance with FIG. 1 secured to a plug of an electrical cord.
Figure 7:
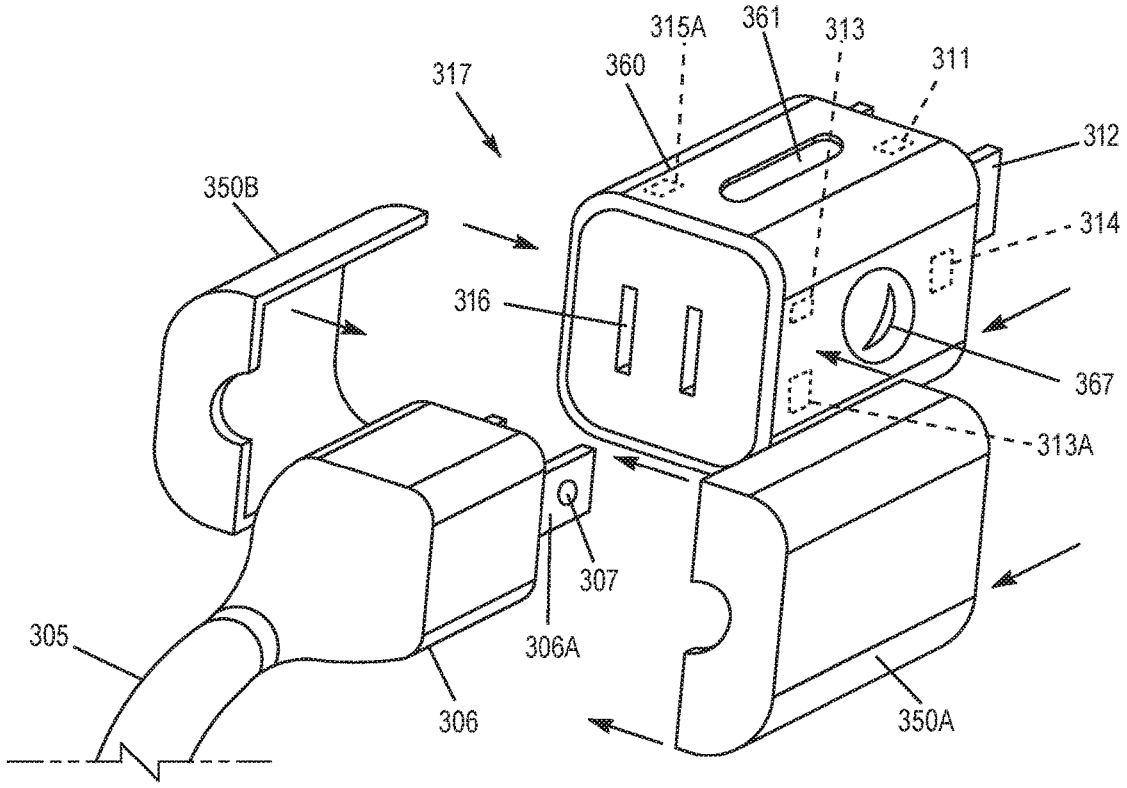
FIG. 7 is a partially exploded view of the plug lock of FIG. 6.

With reference to FIGS. 6-7, another plug lock 310 is provided. The plug lock 310 includes a body 360 with components similar to the components of the plug lock 110 described above with respect to FIG. 1 such as a plug 312, switch 314, socket 316, lock 317, controller 311, wireless communication circuitry 315A, etc. The socket 316 of the body 360 is configured to receive a plug 306 of an electrical device cord 305. The lock 317 may include a pair of retaining members, such as shrouds 350A, 350B, that may be coupled to the body 360 to engage the plug 306 and keep the plug 306 engaged with the socket 316. In one form, the shrouds 350A, 350B are deformable to snap fit onto the body 360. In another form, the shrouds 350A, 350B include a locking structure to be secured to the body 360 by a padlock, such as eyelets of the shrouds 350A, 350B that are aligned with an eyelet of the body 360.

The plug 306 includes prongs 306A having at least one hole 307 through one or both prongs 306A. The lock 317 may include retaining member, such a pin 313, in the body 360. The pin 313 has a locked position wherein the pin 313 extends into the holes 307 and an unlocked position wherein the pin 313 is withdrawn from the holes 307. The pin 313 is made out of a nonconductive material, such as plastic or fiberglass. In one form, the lock 317 includes an actuator 313A such as a motor or a solenoid to drive the pin 313 between unlocked and locked positions. When the controller 311 of the plug lock 310 receives a command to unlock via the wireless communication circuitry 315A of the plug lock 310, the controller 311 operates the actuator 313A causing the pin 313 to shift between locked and unlocked positions and retract from the holes 307. In one form, the pin 313 is biased toward the locked position. The actuator 313A is electrically coupled to the switch 314 of the plug lock 310 that controls power to the socket 316. When the switch 314 is closed, the switch 314 energizes the actuator 313A to shift the pin 313 against the bias of the spring toward the unlocked position to unlock the prongs 307.

In one embodiment, the plug lock 310 includes a key hole 367 in addition to or in place of the actuator that controls the pin 313. By inserting the correct key into the key hole 367 and turning the key, the user can move the pin 313 to fix or release the plug 306. Alternatively the key hole 367 and corresponding key may be substituted by a combination-type lock.

The plug lock 310 includes an indicator 361 that indicates whether or not the plug lock 310 is locked. This indicator 361 enables a user to easily confirm that the plug 306 is secured.

In operation the plug lock 310 retains and secures the plug 306. The switch is 314 is open, such that no electricity is conducted from the plug 312 of the plug lock 310 to the plug 306 of the electrical device. The plug lock 310 receives a signal from a wireless device, and in response to the signal the plug lock 310 closes the switch 314 to power the electrical device. Additionally, the plug lock 310 receives an unlock signal from the wireless device, in response to receiving the unlock signal the plug lock 310 actuates the retainment mechanism, such as the pin 313, to release the plug 306.

A method for using the plug lock 310 to control power to an electrically powered device will be described. First, the plug 306 of an electrically powered device is plugged into the socket 316. The electrically powered device is generally a device that the user wants to control access to. For example, the device may be a corded power tool. As another example, the user may utilize the plug lock 310 to ration the use of a device, such as a television or video game. The plug 306 of the device is secured in the socket 316 by the pin 313. The shrouds 350A, 350B may also be used to secure the plug 306 in the socket 316. The plug 312 of the plug lock 310 is then connected to a wall socket.

The plug lock 310 is communicatively coupled to a computing device, such as the electronic device 130, by means of a communication protocol (such as short-range wireless such as Bluetooth, BLE, NFC, IR, WiFi, Zigbee, and/or long-range wireless such as LoRa, WAN, 3G, 4G, LTE, 5G, etc.). The wireless communication can be direct, or through the gateway 120 and external network 122. The plug lock 310 receives data from the electronic device 130 and transmits data to the electronic device 130 via the wireless communication circuitry 315A of the plug lock 310. The wireless communication circuitry 315A is communicatively coupled to the controller 311 which controls the switch 314. When the controller 311 receives data from the wireless communication circuitry 315A indicating a command to provide power to the cord 305, the controller 311 operates the switch 314 to close the electrical connection between the plug 312 and the socket 316.

In one form, the power signal from the electronic device 130 to the plug lock 310 is a continuous signal. When the signal is interrupted, the controller 311 operates the switch 314 to open the electrical connection between the plug 312 and the socket 316, thereby cutting off power to the cord 305. In one form, the controller 311 includes a timer. The controller 311 waits a predetermined amount of time before opening the switch 314 after loss of the continuous signal. This delay reduces the likelihood of temporary interferences with the signal from the electronic device 130 causing the plug lock 310 to rapidly toggle the switch 314. In another form, the controller 311 operates the switch 314 to close the electrical connection upon receipt of a first signal representing a connect command and to open the electrical connection upon receipt of a second signal representing a disconnect command.

In one form, the electronic device 130 automatically sends a control signal to the plug lock 310 when the electronic device 130 is within a certain proximity to the plug lock 310. For example, the electronic device 130 may be configured to automatically communicate with the plug lock 310 according to a paired relationship whenever the electronic device 130 detects the plug lock 310, such as via Bluetooth® or BLE, and the controller 311 closes the switch 314 whenever the electronic device 130 is paired. Alternatively, the user may have an application on the electronic device 130 that controls the plug lock 310 by using the electronic device's 130 location data, such as from a GPS chip of the electronic device 130, and stored data representing the location of the plug lock 310 to determine the proximity. The application of the electronic device 130 then automatically sends the power signal when the proximity is at or less than a predetermined threshold value.

In another form, the application on the electronic device 130 causes the electronic device 130 to transmit a power signal to the plug lock 310 according to a schedule. The application uses the electronic device's 130 internal clock to set the time of sending the connect and disconnect signals, which causes the plug lock 310 to electrically connect and disconnect the plug 312 and the socket 316 at predetermined times. The user can use the application to set, alter, and/or override the schedule. In another form, the user provides schedule information to the remote resource 123, such as a website, and a computing device associated with the website sends the control signals to the plug lock 310.

In order to disconnect the electrically powered device from the plug lock 310, the user unlocks the lock 317. As described above, disconnecting the lock 317 can be done manually, such as with a key, or electronically by sending an unlock signal to the wireless communication circuitry 315A of the plug lock 310.

In one form, the plug lock 310 includes an anti-tampering device. The anti-tampering device comprises sensors configured to determine if the plug 306 (or the prongs 306A) are becoming disengaged from the socket 316. When disengagement (e.g., movement) is detected by the anti-tampering device, the controller 311 transmits an alert to the electronic device 130 via the wireless communication circuitry 315A.

In one form, the plug lock 310 includes one or more sensors configured to measure how much energy is drawn by the electrically powered device associated with the cord 305. The sensor(s) may measure, for example, one or more of current, voltage, and wattage drawn by the electrical cord 305. The controller 311 may include a memory to store and compile the measured data. The measured data may be transmitted to the electronic device 130 by the wireless communication circuitry 315A. The plug lock 310 may include an internal clock and memory, and the controller 311 may store the measured characteristics of the electrical power drawn by the electrical cord 306 along with an associated timestamp. The controller 311 may intermittently transmit this data to the electronic device 130 by the wireless communication circuitry 315A on a predetermined schedule or when the electronic device 130 is in proximity to the plug lock 310.

The plug lock 310 may take a variety of forms. In one form, the plug lock is a replacement AC wall socket and the at least one power connector includes wires. The wires are wired into the electrical wiring of a house or other structure to provide electrical power to the plug lock.

Although method steps may be presented and described herein in a sequential fashion, one or more of the steps shown and described may be omitted, repeated, performed concurrently, and/or performed in a different order than the order shown in the figures and/or described herein. Those skilled in the art will recognize that a wide variety of modifications, alterations, and combinations can be made with respect to the above described examples without departing from the scope of the invention, and that such modifications, alterations, and combinations are to be viewed as being within the ambit of the inventive concept.

What is claimed is:

1. An apparatus for controlling the use of an electrically powered device, the apparatus comprising:

an electrical socket having openings configured to receive prongs of an electrical plug of an electrical cord of an electrically powered device;

a housing;

a lock configured to retain the electrical plug in the electrical socket, the lock comprising:

a retaining member configured to engage at least one of the prongs in at least one of the openings of the electrical socket; and an actuator connected to the retaining member and configured to shift the retaining member from a locked position wherein the retaining member engages the at least one prong in the at least one opening of the electrical socket and inhibits removal of the at least one prong from the at least one opening to an unlocked position wherein the retaining member permits the at least one prong of the electrical plug to be removed from the at least one opening of the electrical socket;

a switch operable to electrically couple the electrical socket with a power source to which the apparatus is coupled;

wireless communication circuitry operatively coupled to the switch and configured to receive a wireless signal indicating an electronic device is within a proximity of the apparatus; and a controller operatively coupled to the switch, the wireless communication circuitry, and the actuator, the controller configured to, responsive to the wireless signal, cause the switch to electrically couple the power source and the electrical socket and cause the actuator to shift the retaining member from the locked position to the unlocked position and permit the at least one prong to be removed from the at least one opening.

2. The apparatus of claim 1 wherein the retaining member includes a pin having a portion sized to fit into an opening of the at least one prong of the electrical plug.

3. The apparatus of claim 1 further comprising at least one power connector configured to interface the apparatus with the power source.

4. The apparatus of claim 1 further comprising a sensor configured to detect movement of the electrical plug relative to the electrical socket, wherein the controller is configured to cause the wireless communication circuitry to transmit a disengagement signal in response to the sensor detecting movement.

5. The apparatus of claim 1, further comprising a sensor configured to measure at least one characteristic of electricity provided to the electrical socket, wherein the controller is configured to cause the wireless communication circuitry to transmit a signal including data representing the at least one characteristic.

6. The apparatus of claim 1 wherein the wireless communication circuitry is configured to receive a signal transmitted using at least one of: Wi-Fi, Bluetooth, Bluetooth Low Energy (BLE), infrared, Near Field Communication (NFC), ZigBee, Radio Frequency Identification (RFID), and wide-area network communication.

7. The apparatus of claim 1 further comprising a battery electrically coupled to the switch.

8. The apparatus of claim 1 wherein the retaining member includes a pin sized to extend through an opening of the at least one prong.

9. The apparatus of claim 1 wherein the retaining member is biased toward the locked position.

10. The apparatus of claim 1 wherein the controller is configured to, responsive to the wireless communication circuitry no longer receiving the wireless signal:

cause the switch to electrically decouple the power source and the electrical socket, and cause the actuator to shift the retaining member from the unlocked position to the locked position to retain the at least one prong in the at least one opening.

11. An electronic control system for an electrically powered device, the system comprising:

a plug lock;

an electronic device including a wireless transmitter capable of transmitting a wireless signal to the plug lock upon the electronic device being in proximity to the plug lock; and the plug lock comprising:

a housing;

at least one power connector;

an electrical socket having openings configured to receive prongs of an electrical plug of an electrical cord of an electrically powered device;

a lock configured to retain the electrical plug in the electrical socket, the lock comprising:

a retaining member configured to engage at least one of the prongs in at least one of the openings of the electrical socket; and an actuator connected to the retaining member and configured to shift the retaining member from a locked position wherein the retaining member engages the at least one prong in at least one opening of the electrical socket and inhibits removal of the at least one prong from the at least one opening to an unlocked position wherein the retaining member permits the at least one prong of the electrical plug to be removed from the at least one opening of the electrical socket;

wireless communication circuitry configured to receive the wireless signal from the electronic device;

a switch operatively coupled with the at least one power connector, the electrical socket, the actuator, and the wireless communication circuitry, the switch electrically coupling the at least one power connector and the electrical socket in response to the wireless communication circuitry receiving the wireless signal from the electronic device; and wherein the actuator is further configured, upon the switch electrically coupling the at least one power connector and the electrical socket, to shift the retaining member from the locked position to the unlocked position to permit the at least one prong to be removed from the at least one opening.

12. The system of claim 11 further comprising a wireless gateway configured to receive data from an external network and configured to transmit the data to the wireless communication circuitry of the plug lock.

13. The system of claim 12 wherein the electronic device is configured to be connected to the external network and configured to transmit signals to the plug lock via the external network and wireless gateway.

14. The system of claim 11 wherein the plug lock further comprises an anti-tampering system configured to detect removal of the electrical plug from the electrical socket and cause transmission of a signal to the electronic device via the wireless communication circuitry in response to the removal being detected.

15. The system of claim 11 wherein the electronic device is selected from the group consisting of a smartphone, a tablet computer, a personal computer, and a smartwatch.

16. The system of claim 11 wherein the retaining member includes a pin having a portion configured to extend through an opening of the at least one prong.

17. The system of claim 11 wherein the electronic device transmits the wireless signal when the distance of the electronic device relative to the plug lock is less than or equal to a predetermined threshold distance.

18. The system of claim 11 wherein the wireless signal is transmitted via a short-range wireless communication protocol directly between the electronic device and the plug lock.

19. The system of claim 11 wherein the electronic device includes a global positioning system (GPS) receiver and a processor, the processor configured to determine a location of the electronic device and determine whether the electronic device is in proximity to the plug lock by comparing the location of the electronic device to a location of the plug lock.

20. The system of claim 11 wherein the wireless communication circuitry of the electronic device continuously transmits the wireless signal.

21. The system of claim 11 wherein the actuator is configured, upon the switch electrically decoupling the at least one power connector and the electrical socket, to shift the retaining member from the unlocked position to the locked position to retain the at least one prong in the at least one opening.

22. A method for controlling the use of an electrically powered device having an electrical cord using a plug lock, the plug lock having a housing and an electrical socket having openings configured to receive prongs of an electrical plug of the electrical cord, the plug lock having a retaining member and an actuator configured to shift the retaining member from a locked position wherein the retaining member engages at least one prong in at least one opening of the electrical socket and inhibits removal of the at least one prong from the at least one opening to an unlocked position wherein the retaining member permits the at least one prong of the electrical plug to be removed from the at least one opening of the electrical socket, the method comprising:

retaining, by the retaining member in the locked position thereof, the at least one prong of the electrical plug of the electrical cord of the electrically powered device in the at least one opening of the electrical socket of the plug lock;

receiving, from an electronic device, a wireless signal at wireless communication circuitry of the plug lock;

determining whether the electronic device is within a predetermined proximity of the plug lock; and upon the electronic device being determined to be within the predetermined proximity of the plug lock:

operating a switch of the plug lock to electrically couple the electrical socket and a power source, and causing the actuator to shift the retaining member from the locked position to the unlocked position and permit the at least one prong of the electrical plug to be withdrawn from the at least one opening of the electrical socket.

23. The method of claim 22 wherein receiving the wireless signal comprises receiving the wireless signal from a wireless gateway which receives the wireless signal over the internet.

24. The method of claim 22 wherein receiving the wireless signal comprises receiving the wireless signal including data, from the electronic device, representative of a schedule for the switch to be closed.

25. The method of claim 22 further comprising connecting the plug lock to an electrical outlet.

26. The method of claim 22 wherein the retaining member is a nonconductive material.

27. The method of claim 22 further comprising permitting the retaining member to be biased back to the locked position after the actuator has shifted the retaining member to the unlocked position.

28. The method of claim 22, further comprising:

causing the actuator to shift the retaining member from the unlocked position to the locked position to retain the at least one prong of the electrical plug in the at least one opening upon the wireless communication circuitry of the plug lock no longer receiving the wireless signal.

* * * * *